US007515728B2

(12) United States Patent
Kobayashi et al.

(10) Patent No.: US 7,515,728 B2
(45) Date of Patent: Apr. 7, 2009

(54) SPEAKER APPARATUS

(75) Inventors: Hiroyuki Kobayashi, Yamagata (JP); Kyoichi Matsuda, Yamagata (JP)

(73) Assignees: Pioneer Corporation, Tokyo (JP); Tohoku Pioneer Corporation, Yamagata (JP)

( * ) Notice: Subject to any disclaimer, the term of this patent is extended or adjusted under 35 U.S.C. 154(b) by 0 days.

(21) Appl. No.: 11/012,297

(22) Filed: Dec. 16, 2004

(65) Prior Publication Data

US 2005/0141746 A1 Jun. 30, 2005

(30) Foreign Application Priority Data

Dec. 24, 2003 (JP) ..... P2003-428374

(51) Int. Cl.
*H04R 25/00* (2006.01)

(52) U.S. Cl. ..... 381/398; 381/403; 381/404; 381/423; 381/429; 381/424

(58) Field of Classification Search ..... 381/342, 381/184–186, 386, 395, 396, 398, 412, 423, 381/424, 400–405, 407, 426, 429; 181/144, 181/146, 167, 163–165, 171, 173, 174
See application file for complete search history.

(56) References Cited

U.S. PATENT DOCUMENTS 4,029,911 A * 6/1977 Albinger ..... 381/398
4,158,756 A * 6/1979 Keezer ..... 381/433
4,456,797 A * 6/1984 Olsen ..... 381/311
4,764,968 A * 8/1988 Kreitmeier ..... 381/432
5,394,479 A * 2/1995 Ishigaya et al. ..... 381/394
6,243,479 B1 * 6/2001 Proni ..... 381/420
6,678,387 B2 * 1/2004 Kemmerer ..... 381/397
2003/0185415 A1 * 10/2003 Funahashi et al. ..... 381/398
2004/0086143 A1 * 5/2004 Espiritu ..... 381/398
2005/0078849 A1 * 4/2005 Funahashi et al. ..... 381/412
2008/0212821 A1 * 9/2008 Funahashi et al. ..... 381/398

FOREIGN PATENT DOCUMENTS

JP 63-155900 A 6/1988
JP 11-262085 A 9/1999
WO 03/065760 A2 8/2003

OTHER PUBLICATIONS

Japanese Office Action issued Nov. 19, 2008.

* cited by examiner

*Primary Examiner*—Wayne R Young
*Assistant Examiner*—Dionne H Pendleton
(74) *Attorney, Agent, or Firm*—Sughrue Mion, PLLC

(57) ABSTRACT

A speaker apparatus including: a first diaphragm; a second diaphragm arranged coaxial with the first diaphragm along a driving direction; a frame having diaphragm supporting portions; and a voice-coil bobbin, wherein outer circumferential portions of the first diaphragm and the second diaphragm are fixed to the diaphragm supporting portions respectively, inner circumferential portions of the first diaphragm and the second diaphragm are connected together and fixed to the voice-coil bobbin so as to make a sealed space between the first diaphragm, the second diaphragm and the frame, and the voice-coil bobbin is supported by springiness of a gas contained in the sealed space.

23 Claims, 3 Drawing Sheets

SPEAKER APPARATUS

CROSS-REFERENCE TO RELATED APPLICATION

The invention claims priority to Japanese Patent Application No. JP 2003-428374 filed on Dec. 24, 2003. The disclosure of the prior application is incorporated herein by reference in its entirety.

BACKGROUND OF THE INVENTION

1. Field of the Invention

The present invention relates to a speaker apparatus, and more particularly, to an improvement for realizing a reduced thickness of a speaker apparatus by reducing a dimension in an axial direction thereof.

2. Description of the Related Art

FIG. 1 shows a conventional construction of an general type of an electrodynamic speaker apparatus.

This speaker apparatus 1 is configured with a magnetic circuit 3, a frame 5 to which the magnetic circuit 3 is attached on a rear end, a cone-shaped diaphragm 9 having a peripheral roll-shaped edge 7 fixed to a diaphragm supporting portion 5*a*, which is a front end of the frame 5, and a voice coil 12 wound on a cylindrical voice-coil bobbin 11.

The magnetic circuit 3 is configured with a yoke 15 having a structure in which a cylindrical center pole 15*b* is projected from a center of a disk-shaped plate 15*a*, a ring-shaped magnet 16 loosely fitted on a periphery of the center pole 15*b*, and a ring-shaped top plate 17 equipped to be loosely fitted on a front edge of the center pole 15*b* so as to hold the magnet 16 therebetween with the plate 15*a*.

A space between an inner circumference of the top plate 17 and the center pole 15*b* forms a magnetic gap 19 in which the voice coil 12 is disposed.

An opening 9*a* through which the voice-coil bobbin 11 is penetrated is formed in a center of the diaphragm 9. The edge 7 connected to a peripheral edge of the diaphragm 9 is fixed to the diaphragm supporting portion 5*a* in such a manner that a mounting flange portion 7*a* provided along an outer circumference of the edge 7 is caught between the diaphragm supporting portion 5*a* and a ring-shaped gasket 21 stuck to the diaphragm supporting portion 5*a*. An inner circumferential portion 9*b* of the diaphragm 9 which forms the opening 9*a* is fixed to a periphery of the voice-coil bobbin 11 penetrated through the opening 9*a* by adhesion or the like.

A dust cap 23 is stuck to a central portion of the diaphragm 9. This dust cap 23 covers a front end of the voice-coil bobbin 11 to prevent dust or the like from entering the magnetic gap 19.

The cylindrical voice-coil bobbin 11 is loosely fitted on the periphery of the center pole 15*b* in an axially movable state, and is elastically supported on the frame 5 by means of a damper 25 so that its axial movement is restricted.

In general, a damper in which a corrugated structure is formed concentrically with respect to the voice-coil bobbin 11 is widely used as the damper 25 (refer to, for example, JP-A-63-155900 and JP-A-11-262085).

The damper 25 has a peripheral edge fixed to a damper supporting portion 5*b* of the frame 5 and an inner circumferential portion fixed to the periphery of the voice-coil bobbin 11, and restricts radial displacement of the voice-coil bobbin 11. In addition, while the diaphragm 9 is being driven, the damper 25 absorbs vibration energy of the diaphragm 9 by deformation of the corrugated structure, thereby performs vibration damping on the diaphragm 9.

The frame 5 generally has a structure in which openings 5*c* are arbitrarily provided between the diaphragm supporting portion 5*a* and the damper supporting portion 5*b*. These openings 5*c* serve as air holes for releasing back pressures when the diaphragm 9 is being driven, at the same time, serve to reduce a weight of the frame 5.

In the speaker apparatus 1, when an acoustic signal is input to the voice coil 12 via input terminals and lead wires (none of which is shown), the diaphragm 9 is vibrated by reciprocating vibrations of the voice-coil bobbin 11, thereby performs sound reproduction.

SUMMARY OF THE INVENTION

Recently, there has been a number of in-car audio systems, which equips speaker apparatus for reproducing deep bass, such as woofers and subwoofers.

A problem important to these in-car audio systems is to reduce a thickness of a speaker apparatus so that the speaker apparatus can be mounted into a space where a diameter of depth is limited such as a door and a ceiling panel of a vehicle.

However, in a conventional speaker apparatus 1 in which a voice-coil bobbin 11 is elastically supported by a damper 25 as described above, a space in which the damper 25 is disposed must be ensured between a diaphragm 9 and a magnetic circuit 3, so that an installation space for the damper 25 makes it difficult to reduce an axial dimension of the speaker apparatus 1 and becomes a bottleneck for a reduction in the thickness of the speaker apparatus 1.

In addition, the damper 25 is generally larger in stiffness than an edge 7 and suffers mechanical fatigue due to long term use earlier than the edge 7 does, and there is a risk that degradation in a control performance of the damper 25 causes a failure.

Furthermore, abnormal vibrations and rustling sounds occur due to the deformation of the corrugated structure during propagation of vibrations between adjacent ridges of the corrugated structure of the damper 25, and there is a possibility that those abnormal vibrations and rustling sounds conversely affect the vibrations of the voice coil 12 and the diaphragm 9 and impair sound quality.

Following problems can be enumerated as problems that the invention is to solve by way of example: a problem that since it is necessary to ensure the installation space for the damper, the axial dimension of the speaker apparatus is difficult to reduce; a problem that in long term use, a lowering of the supporting performance of the damper due to mechanical fatigue causes failures; and a problem that abnormal vibrations and rustling sounds occur due to the deformation of the damper.

To solve these problem, according to the invention, there is provided a speaker apparatus including: a first diaphragm; a second diaphragm arranged coaxial with the first diaphragm along a driving direction; a frame having diaphragm supporting portions; and a voice-coil bobbin, wherein outer circumferential portions of the first diaphragm and the second diaphragm are fixed to the diaphragm supporting portions respectively, inner circumferential portions of the first diaphragm and the second diaphragm are connected together and fixed to the voice-coil bobbin so as to make a sealed space between the first diaphragm, the second diaphragm and the frame, and the voice-coil bobbin is supported by springiness of a gas contained in the sealed space.

BRIEF DESCRIPTION OF THE DRAWING

These and other objects and advantages of this invention will become more fully apparent from the following detailed description taken with the accompanying drawings in which.

DETAILED DESCRIPTION OF THE PREFERRED EMBODIMENTS

Preferred embodiments of a speaker apparatus according to the invention will be described below in detail with reference to the accompanying drawings.

First Embodiment

Figure 1:
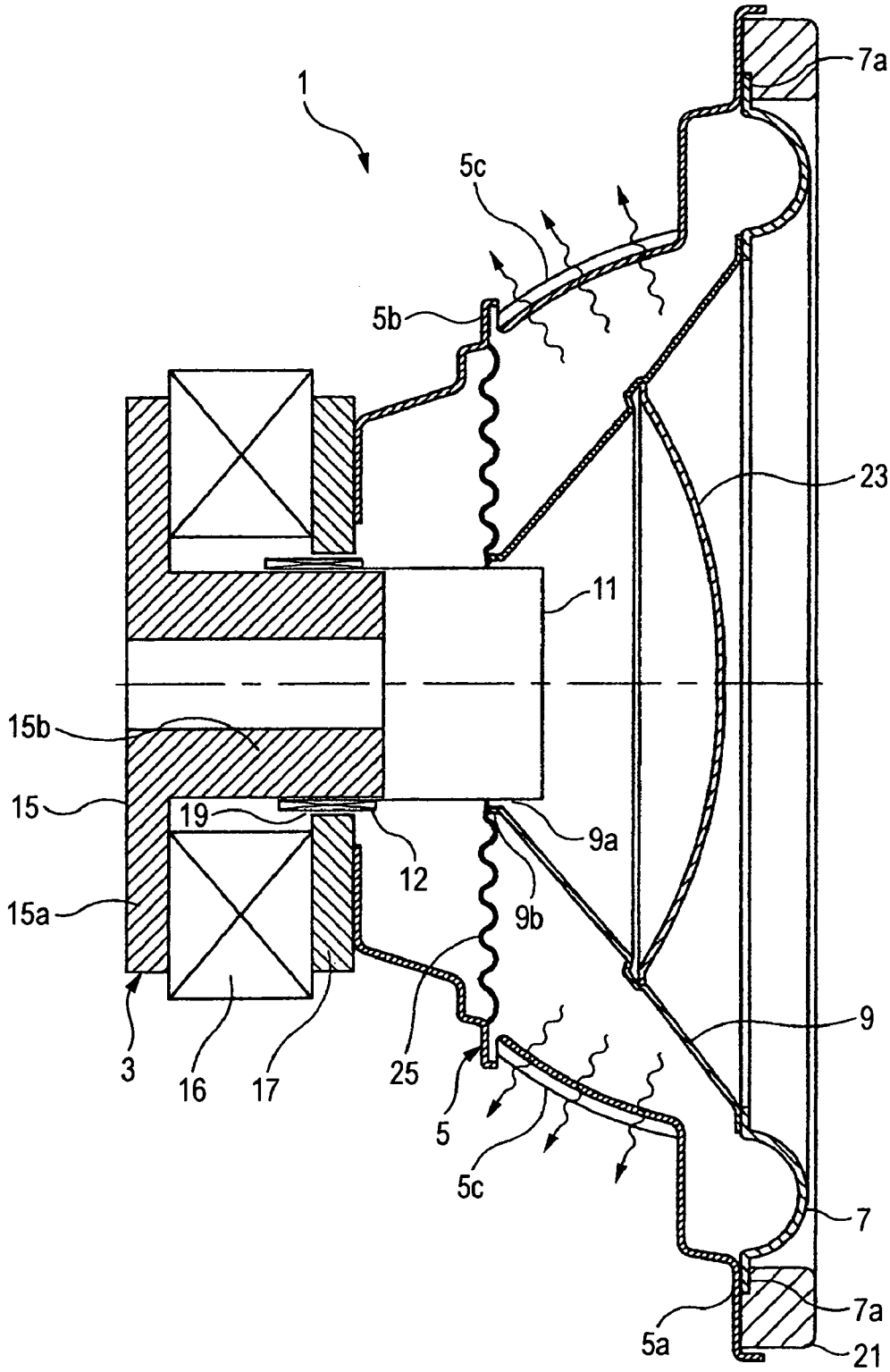
FIG. 1 PRIOR ART
FIG. 1 is a longitudinal section view showing the construction of an existing speaker apparatus.
Figure 2:
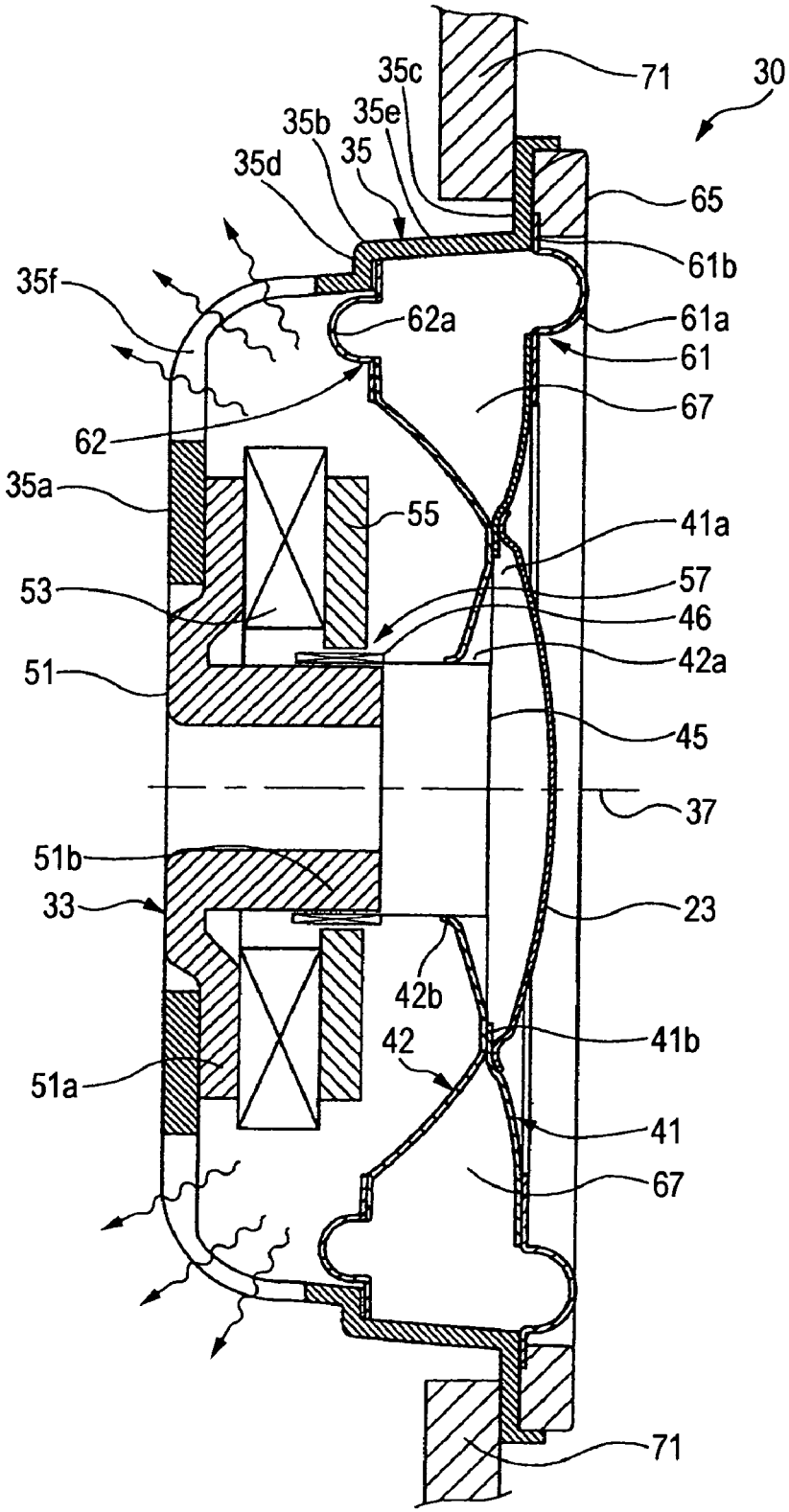
FIG. 2 is a longitudinal sectional view of a first embodiment of a speaker apparatus according to the invention.
Figure 3:
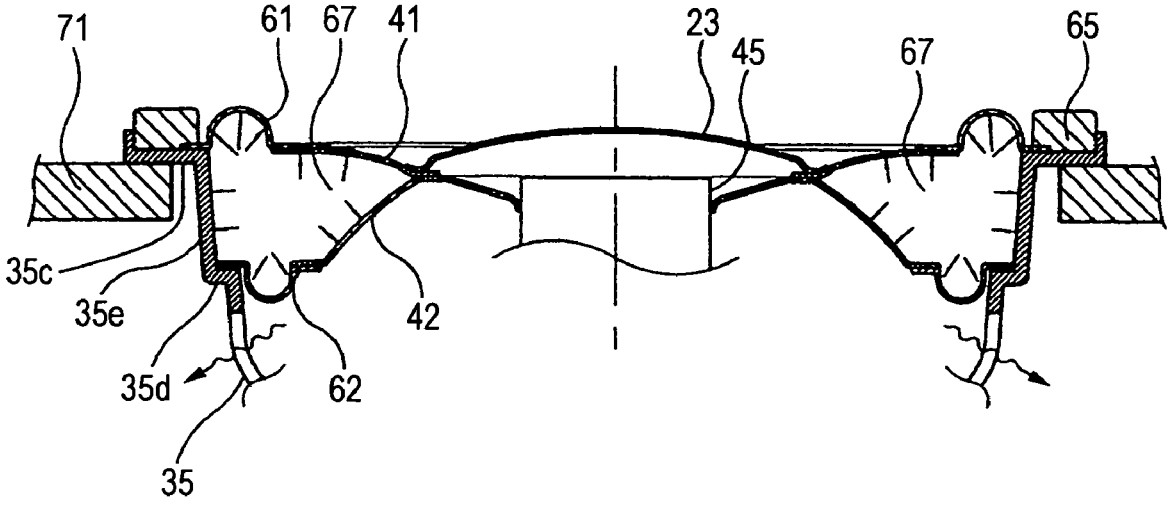
FIG. 3 is an explanatory view of the operation of the speaker apparatus shown in FIG. 2.

FIG. 2 is a longitudinal sectional view of a first embodiment of a speaker apparatus according to the invention, and FIG. 3 is an explanatory view of an operation of the speaker apparatus shown in FIG. 2 when being driven.

As shown in FIG. 2, a speaker apparatus 30 of the first embodiment is configured with a magnetic circuit 33, a frame 35 to which the magnetic circuit 33 is attached on a rear end, a first diaphragm 41 and a second diaphragm 42, which are arranged coaxially with a driving direction (direction parallel to a center line 37 of the speaker apparatus 30), and a voice coil 46 wound on a cylindrical voice-coil bobbin 45.

The magnetic circuit 33 is configured with a yoke 51 having a structure in which a cylindrical center pole 51*b* is projected from a center of a disk-shaped plate 51*a*, a ring-shaped magnet 53 loosely fitted on a periphery of the center pole 51*b*, and a ring-shaped top plate 55, which is equipped to be loosely fitted on a front edge of the center pole 51*b* so as to hold the magnet 53 therebetween with the plate 51*a*. A space between an inner circumference of the top plate 55 and the center pole 51*b* forms a magnetic gap 57 in which the voice coil 46 is disposed.

The frame 35 has a shallow bowl-like shape, and the magnetic circuit 33 is attached to an inner surface of a bottom plate portion 35*a* with the plate 51*a* of the yoke 51 placed on the inner surface of the same.

This frame 35 is provided with a diaphragm supporting portion 35*c* for the first diaphragm 41 and a diaphragm supporting portion 35*d* for the second diaphragm 42 at positions apart from each other along the driving direction, respectively.

A circumferential wall 35*b* provided between these two diaphragm supporting portions 35*c* and 35*d* is a sealed wall having no openings at all, but openings 35*f*, which serve as vent holes for releasing back pressures of the diaphragms 41 and 42 are arbitrarily provided between the diaphragm supporting portion 35*d* and the bottom plate portion 35*a*.

It is to be noted that a back surface of the diaphragm supporting portion 35*c* of the frame 35 serves as a flange surface to be fixed in close contact with a baffle 71 of a speaker cabinet.

The first diaphragm 41 and the second diaphragm 42 are cone-shaped diaphragms, and edges 61 and 62, which are their respective outer circumferential portions, are respectively fixed to diaphragm supporting portions 35*c* and 35*d* of the frame 35, while inner circumferential portions 41*b* and 42*b* are connected together and are fixed to the voice-coil bobbin 45.

These edges 61 and 62 preferably use members each made of a material with high internal loss, for the purpose of attenuating vibrations transmitted from cone papers, which form bodies of the respective diaphragms 41 and 42. For example, it is preferable to form the edges 61 and 62 by connecting members made of materials different from the cone papers (materials higher in internal loss than that of the cone papers) to the respective diaphragms 41 and 42.

The first diaphragm 41 disposed on the front side of the speaker apparatus has a central opening whose diameter is set to be larger than the diameter of the opening of the second diaphragm 42 disposed on the front side of the speaker apparatus, and the edge 61 is provided with a swollen portion 61*a* which is swollen outwardly (toward the front side of the speaker apparatus) from a sealed spaced 67 between the first and second diaphragms 41 and 42.

The second diaphragm 42 disposed on the back side of the first diaphragm 41 has a central opening whose diameter is set to be approximately equal to the outside diameter of the voice-coil bobbin 45, and the edge 62 is provided with a swollen portion 62*a* which is swollen outwardly (toward the back of the speaker apparatus) from the sealed spaced 67 between the first and second diaphragms 41 and 42.

Incidentally, the swelling directions of the swollen portion 61*a* and the swollen portion 62*a* are not limited to those shown in FIG. 2.

The edges 61 and 62 of the first and second diaphragms 41 and 42 are respectively fixed to the two diaphragm supporting portions 35*c* and 35*d* of the frame 35.

Incidentally, the edge 61 of the first diaphragm 41 is fixed to the diaphragm supporting portion 35*c* in such a manner that a mounting flange portion 61*b* formed to extend from the outer circumferential portion of the edge 61 is caught between a gasket 65 and the diaphragm supporting portion 35*c*.

The inner circumferential portion 41*b* of the first diaphragm 41 is connected to the second diaphragm 42 in the state of overlapping the second diaphragm 42 positioned behind the inner circumferential portion 41*b*.

The dust cap 23 is equipped to be stuck to the central portion of the first diaphragm 41. This dust cap 23 covers the front end of the voice-coil bobbin 45 to prevent dust or the like from entering the magnetic gap 57.

The inner circumferential portion 42*b* of the second diaphragm 42 is arbitrarily fixed to the periphery of the voice-coil bobbin 45 by an adhesive, thereby realizing a structure in which the inner circumferential portions 41*b* and 42*b* of the first and second diaphragms 41 and 42 are connected together and are fixed to the voice-coil bobbin 45.

The cylindrical voice-coil bobbin 45 is loosely fitted on the periphery of the center pole 51*b* in an axially movable state, and is positioned in both the radial and axial directions by the second diaphragm 42 connected to the periphery of the voice-coil bobbin 45.

In the case of the first embodiment, the space 67 surrounded by the first and second diaphragms 41 and 42 and the frame 35 is gas-tightly sealed.

When the first and second diaphragms 41 and 42 are driven by the axial displacement of the voice-coil bobbin 45, a gas such as air which is sealed in the sealed spaced 67 between the first and second diaphragms 41 and 42 is compressed as shown in FIG. 3 by the displacements of the first and second diaphragms 41 and 42 and the displacements of the edges 61*a* and 62*a*, thereby providing springiness like an air spring.

In the first embodiment, letting S1 be the effective area of the first diaphragm 41 and S2 be the effective area of the second diaphragm 42, the difference S between the effective areas is S=S1−S2. Letting V be the volume of air in the sealed spaced 67 between the first and second diaphragms 41 and 42, stiffness which is a constant indicative of the springiness of the air spring can be made proportional to S/V.

Namely, in the first embodiment, the voice-coil bobbin 45 is controllably supported by the springiness of the air spring which is given to the sealed spaced 67 between the first and second diaphragms 41 and 42.

In the speaker apparatus 30 according to the first embodiment, the air-spring-like springiness of the sealed spaced 67 between the first and second diaphragms 41 and 42 absorbs the vibration energy of the voice-coil bobbin 45 and the first and second diaphragms 41 and 42 to perform control of the voice-coil bobbin 45 and the first and second diaphragms 41 and 42, so that there is no need for a control damper of the type which would have been provided in existing speaker apparatuses.

Namely, in the speaker apparatus 30, since the first and second diaphragms 41 and 42 themselves serve as a damper for controlling the vibrations of the first and second diaphragms 41 and 42 and the voice-coil bobbin 45, a damper for elastically supporting the voice-coil bobbin 45 need not be equipped behind the first and second diaphragms 41 and 42. Accordingly, the axial dimension of the speaker apparatus can be reduced by the omission of a damper and an installation space therefor, thereby realizing a reduction in the thickness of the speaker apparatus 30 which is demanded in in-car audio systems and the like.

In addition, the second diaphragm 42 which is equipped coaxially behind the first diaphragm 41 for the purpose of realizing the sealed spaced 67 between the first and second diaphragms 41 and 42 may use a material common to the first diaphragm 41, and does not easily suffer mechanical fatigue, as compared with dampers having existing bellows structures. Accordingly, it is possible to prevent the lowering of damping performance due to the mechanical fatigue of constituent parts, thereby realizing longer life of the speaker apparatus.

Furthermore, unlike the case of existing dampers having a bellows structure in which deformation is transferred from each ridge of the bellows (an undulating portion) to the adjacent ridge during vibration propagation, a locally large deformation does not occur in the first diaphragm 41 or the second diaphragm 42, whereby abnormal vibrations and rustling sounds which degrade sound quality do not occur and the reproduction of high-quality pure sound can be realized.

In addition, in the speaker apparatus 30 of the first embodiment, the edges 61 and 62 of the first and second diaphragms 41 and 42 become resistant to deformations due to back pressures with the aid of the pressure of the gas contained in the sealed spaced 67 between the first and second diaphragms 41 and 42. In addition, since the second diaphragm 42 and the edge 62 bear back pressures, the magnitude of back pressures acting on the first diaphragm 41 which performs sound reproduction can be decreased to improve the quality of reproduced sound.

Second Embodiment

Figure 4:
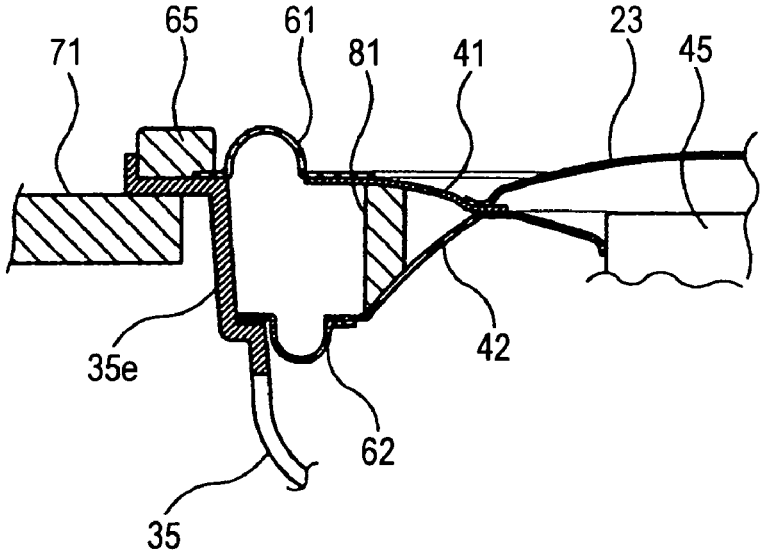
FIG. 4 is a longitudinal sectional view of an essential portion of a second embodiment of the speaker apparatus according to the invention.

FIG. 4 is a longitudinal sectional view of an essential portion of a second embodiment of a speaker apparatus according to the invention.

In a speaker apparatus 40 according to the second embodiment, the first diaphragm 41 and the second diaphragm 42 which are coaxially arranged in the speaker apparatus 30 of the first embodiment shown in FIGS. 2 and 3 are connected by ribs 81 (connecting members) as shown in FIG. 4. The ribs 81 are arbitrarily equipped at a plurality of locations at predetermined intervals.

Since the first and second diaphragms 41 and 42 are connected by the ribs 81, the rigidity of each of the first diaphragm 41 and the second diaphragm 42 which form the sealed spaced 67 therebetween is strengthened, whereby high-quality sound reproduction can be realized by the improvement of the propagation speed of sound vibration and the like.

In addition, since the first and second diaphragms 41 and 42 are connected by the ribs 81, vibration energy is rapidly dispersed into a wide area of each of the first and second diaphragms 41 and 42 so that the local distortion thereof can be restrained, whereby it is possible to reduce loads which are imposed on the first and second diaphragms 41 and 42 by the vibration energy to be absorbed, and it is possible to improve the fatigue resistance of the first and second diaphragms 41 and 42.

In each of the first and second embodiments, the second diaphragm 42 positioned on the back side of the first diaphragm 41 is made smaller in inside diameter than the first diaphragm 41 positioned on the front side, and the inner circumferential portion of the second diaphragm 42 is connected to the voice-coil bobbin 45. However, conversely, the first diaphragm 41 can also be made smaller in inside diameter than the second diaphragm 42 to adopt a structure in which the inner circumferential portion of the second diaphragm 42 is integrally connected to an intermediate portion of the first diaphragm 41 and the inner circumferential portion of the first diaphragm 41 is connected to the voice-coil bobbin 45.

Furthermore, it is also possible to adopt a construction in which the inside diameters of the first and second diaphragms 41 and 42 are made coincident with the outside diameter of the voice-coil bobbin 45 and their inner circumferential portions are directly connected to the voice-coil bobbin 45.

As described hereinabove in detail, each of the speaker apparatuses 30 and 40 according to the first and second embodiments includes the first diaphragm 41 and the second diaphragm 42, which are arranged coaxially along the driving direction, and the outer circumferential portions 61 and 62 of the first diaphragm 41 and the second diaphragm 42 are fixed to the diaphragm supporting portions 35*c* and 35*d* of the frame 35, while the inner circumferential portions 41*b* and 42*b* of the first diaphragm 41 and the second diaphragm 42 are connected together and are fixed to the voice-coil bobbin 45. The spaced 67 surrounded by the first diaphragm 41, the second diaphragm 42 and the frame 35 is sealed, and the voice-coil bobbin 45 is supported by the springiness of the gas contained in the sealed spaced 67.

Accordingly, the air-spring-like springiness of the sealed spaced 67 between the first and second diaphragms 41 and 42 performs control of the vibrations of the voice-coil bobbin 45 and the first and second diaphragms 41 and 42, so that there is no need for an exclusive damper for control.

Accordingly, the axial dimension of the speaker apparatus 30 can be reduced by the omission of a damper and an installation space therefor, thereby realizing a reduction in the thickness of the speaker apparatus 30 which is demanded in in-car audio systems in particular.

Since the second diaphragm 42 can use a material common to the first diaphragm 41, the second diaphragm 42 is light in mass and does not easily suffer mechanical fatigue, as compared with dampers having existing bellows structures. Accordingly, it is possible to prevent the lowering of damping performance due to the mechanical fatigue of constituent parts, thereby realizing longer life of the speaker apparatus. Furthermore, since a locally large deformation does not occur, abnormal vibrations and rustling sounds which degrade sound quality do not occur and the reproduction of high-quality pure sound can be realized.

The foregoing description of preferred embodiments of the invention has been presented for purposes of illustration and description. It is not intended to be exhaustive or to limit the invention to the precise form disclosed, and modifications and variations are possible in light of the above teachings or may be acquired from practice of the invention. The embodiments were chosen and described in order to explain the principles of the invention and its practical application to enable one skilled in the art to utilize the invention in various embodiments and with various modifications as are suited to the particular use contemplated. It is intended that the scope of the invention be defined by the claims appended hereto, and their equivalents.

What is claimed is:

1. A speaker apparatus comprising:

a first diaphragm;

a second diaphragm arranged coaxial with the first diaphragm along a driving direction;

a frame having diaphragm supporting portions; and a voice-coil bobbin, wherein outer circumferential portions of the first diaphragm and the second diaphragm are fixed to the diaphragm supporting portions respectively, the second diaphragm has an inner edge and an outer edge and has a curved shape, wherein a distance from the inner edge to an apex of the curve is substantially the same distance as a distance from the outer edge to the apex of the curve;

an inner circumferential portion of the first diaphragm is connected to the second diaphragm at a contact portion substantially at the apex of the curve, and the inner edge of the second diaphragm is fixed directly to the voice-coil bobbin so as to make a sealed space between the first diaphragm, the second diaphragm and the frame, and the voice-coil bobbin is supported by springiness of a gas contained in the sealed space.

2. The speaker apparatus according to claim 1, wherein the first diaphragm and the second diaphragm are respectively fixed to the diaphragm supporting portions at positions spaced apart from each other along the driving direction.

3. The speaker apparatus according to claim 1, flirt her comprising a connecting member, which connects the first diaphragm and the second diaphragm.

4. The speaker apparatus according to claim 1, wherein the first diaphragm and the second diaphragm include a diaphragm body respectively, which is made of a different member from each outer circumferential portion.

5. The speaker apparatus as claimed in claim 1, wherein the contact portion of the first diaphragm contacts the contact portion of the second diaphragm at the contact point to make a sealed space defined by the first diaphragm, the second diaphragm, and the frame.

6. A speaker apparatus comprising:

a first diaphragm;

a second diaphragm arranged coaxially with the first diaphragm along a driving direction;

a frame having a first diaphragm support and a second diaphragm support; and a voice-coil bobbin, wherein the first diaphragm support is spaced apart from the second diaphragm support on the frame in the driving direction, wherein an outer circumferential portion of the first diaphragm is connected to the first diaphragm support and an outer circumferential portion of the second diaphragm is connected to the second diaphragm support, the second diaphragm has an inner edge and an outer edge and has a curved shape, wherein a distance from the inner edge to an apex of the curve is substantially the same distance as a distance from the outer edge to the apex of the curve;

wherein a contact portion of the first diaphragm, which is located inwardly from the outer circumferential portion of the first diaphragm, contacts a contact portion of the second diaphragm at a contact portion which is disposed substantial at the apex of the curve of the second diaphragm, wherein the inner edge of the second diaphragm contacts the voice coil bobbin at a bobbin contact point wherein the contact portion of the first diaphragm contacts the contact portion of the second diaphragm at the contact point to make a sealed space defined by the first diaphragm, the second diaphragm, and the frame; and wherein the voice-coil bobbin is supported by springiness of a gas contained in the sealed space.

7. The speaker apparatus as claimed in claim 6, wherein an inner circumferential edge of the first diaphragm contacts the second diaphragm at the contact point.

8. A speaker apparatus comprising:

a first diaphragm;

a second diaphragm arranged coaxial with the first diaphragm along a driving direction;

a frame having diaphragm supporting portions;

a voice-coil bobbin; and a dust cap, wherein outer circumferential portions of the first diaphragm and the second diaphragm are fixed to the diaphragm supporting portions respectively, the second diaphragm has an inner edge and an outer edge and has a curved shape, wherein a distance from the inner edge to an apex of the curve is substantially the same distance as a distance from the outer edge to the apex of the curve;

an inner circumferential portion of the first diaphragm is connected to the second diaphragm at a connecting portion which is disposed substantially at the apex of the curve of the second diaphragm, the inner edge of the second diaphragm is fixed directly to the voice-coil bobbin at a bobbin contact point, and the dust cap is located near the connecting portion.

9. The speaker apparatus according to claim 8, wherein:

the apex of the curve of the second diaphragm includes a flexion portion that is convexly curved toward the first diaphragm; and the connecting portion is located near the flexion portion.

10. The speaker apparatus according to claim 8, wherein the first diaphragm and the second diaphragm are respectively fixed to the diaphragm supporting portions at positions spaced apart from each other along the driving direction.

11. The speaker apparatus according to claim 8, further comprising a connecting member, which connects the first diaphragm and the second diaphragm.

12. The speaker apparatus according to claim 8, further comprising a vent hole disposed on the frame opposed to a rear surface of the second diaphragm.

13. The speaker apparatus as claimed in claim 8, wherein the contact portion of the first diaphragm contacts the contact portion of the second diaphragm at the contact point to make a sealed space defined by the first diaphragm, the second diaphragm, and the frame.

14. A speaker apparatus comprising:

a first diaphragm;

a second diaphragm arranged coaxial with the first diaphragm along a driving direction;

a frame having diaphragm supporting portions;

a voice-coil bobbin; and a dust cap, wherein an outer circumferential portions of the first diaphragm and the second diaphragm are fixed to the diaphragm supporting portions respectively, the second diaphragm has an inner edge and an outer edge and has a curved shape, wherein a distance from the inner edge to an apex of the curve is substantially the same distance as a distance from the outer edge to the apex of the curve;

wherein an inner circumferential portion of the first diaphragm is connected to the second diaphragm at a connecting portion which is disposed substantially at the apex of the curve of the second diaphragm, wherein the inner edge of the second diaphragm is fixed directly to the voice-coil bobbin, wherein the dust cap is located near the connecting portion, wherein the first diaphragm and the second diaphragm include a diaphragm body respectively, which is made of a different member from each outer circumferential portion.

15. The speaker apparatus as claimed in claim 14, wherein the contact portion of the first diaphragm contacts the contact portion of the second diaphragm at the contact point to make a sealed space defined by the first diaphragm, the second diaphragm, and the frame.

16. A speaker apparatus comprising:

a first diaphragm;

a second diaphragm arranged coaxial with the first diaphragm along a driving direction;

a frame having diaphragm supporting portions;

a voice-coil bobbin; and a dust cap, wherein outer circumferential portions of the first diaphragm and the second diaphragm are fixed to the diaphragm supporting portions respectively, the second diaphragm has an inner edge and an outer edge and has a curved shape, wherein a distance from the inner edge to an apex of the curve is substantially the same distance as a distance from the outer edge to the apex of the curve;

an inner circumferential portion of the first diaphragm is connected to the second diaphragm at a connecting portion which is disposed substantially at the apex of the curve of the second diaphragm and the second diaphragm is fixed to the voice-coil bobbin at a bobbin contact point, the dust cap is located near the connecting portion.

17. The speaker apparatus according to claim 16, wherein the first diaphragm and the second diaphragm are respectively fixed to the diaphragm supporting portions at positions spaced apart from each other along the driving direction.

18. The speaker apparatus according to claim 16, further comprising a connecting member, which connects the first diaphragm and the second diaphragm.

19. The speaker apparatus according to claim 16, further comprising a vent hole disposed on the frame opposed to a rear surface of the second diaphragm.

20. The speaker apparatus as claimed in claim 16, wherein the contact portion of the first diaphragm contacts the contact portion of the second diaphragm at the contact point to make a sealed space defined by the first diaphragm, the second diaphragm, and the frame.

21. A speaker apparatus comprising:

a first diaphragm;

a second diaphragm arranged coaxial with the first diaphragm along a driving direction;

a frame having diaphragm supporting portions;

a voice-coil bobbin; and a dust cap, wherein outer circumferential portions of the first diaphragm and the second diaphragm are fixed to the diaphragm supporting portions respectively, the second diaphragm has an inner edge and an outer edge and has a curved shape, wherein a distance from the inner edge to an apex of the curve is substantially the same distance as a distance from the outer edge to the apex of the curve;

wherein an inner circumferential portion of the first diaphragm is connected to the second diaphragm substantially at the apex of the curve of the second diaphragm and the second diaphragm is fixed directly to the voice-coil bobbin, wherein the dust cap is located near the connecting portion, and wherein the first diaphragm and the second diaphragm include a diaphragm body respectively, which is made of a different member from each outer circumferential portion.

22. The speaker apparatus as claimed in claim 21, wherein the contact portion of the first diaphragm contacts the contact portion of the second diaphragm at the contact point to make a sealed space defined by the first diaphragm, the second diaphragm, and the frame.

23. A speaker apparatus comprising:

a first diaphragm;

a second diaphragm arranged coaxial with the first diaphragm along a driving direction;

a frame having diaphragm supporting portions;

a voice-coil bobbin; and a dust cap, wherein outer circumferential portions of the first diaphragm and the second diaphragm are fixed to the diaphragm supporting portions respectively, the second diaphragm has an inner edge and an outer edge and has a curved shape, wherein a distance from the inner edge to an apex of the curve is substantially the same distance as a distance from the outer edge to the apex of the curve;

the inner edge of the second diaphragm is fixed to the voice-coil bobbin at a bobbin contact point, the dust cap is located near the connecting portion, the apex of the curve of the second diaphragm includes a flexion portion that is convexly curved toward the first diaphragm; and the connecting portion is located near the flexion portion.

* * * * *